US006312080B1

(12) United States Patent
De Roos et al.

(10) Patent No.: US 6,312,080 B1
(45) Date of Patent: Nov. 6, 2001

(54) INK JET PRINTER

(75) Inventors: Mike De Roos, Kungsängen; Christer Boström, Åkersberga, both of (SE)

(73) Assignee: XaarJet AB (SE)

( * ) Notice: Subject to any disclaimer, the term of this patent is extended or adjusted under 35 U.S.C. 154(b) by 0 days.

(21) Appl. No.: 09/530,032

(22) PCT Filed: Oct. 30, 1998

(86) PCT No.: PCT/SE98/01962

§ 371 Date: Jul. 21, 2000

§ 102(e) Date: Jul. 21, 2000

(87) PCT Pub. No.: WO99/22938

PCT Pub. Date: May 14, 1999

(30) Foreign Application Priority Data

Oct. 30, 1997 (SE) ..... 9703983
Jun. 16, 1998 (SE) ..... 9802142

(51) Int. Cl.[7] ..... B41J 29/38; B41J 2/045
(52) U.S. Cl. ..... 347/14; 347/10; 347/69
(58) Field of Search ..... 347/9, 14

(56) References Cited

U.S. PATENT DOCUMENTS 4,275,402 6/1981 Kern ..... 347/14

FOREIGN PATENT DOCUMENTS 0 641 656 9/1994 (EP) ..... B41J/2/05
0 778 132 12/1996 (EP) ..... B41J/2/045

*Primary Examiner*—John Barlow
*Assistant Examiner*—Alfred Dudding
(74) *Attorney, Agent, or Firm*—Fay, Sharpe, Fagan, Minnich & McKee, LLP

(57) ABSTRACT

The invention relates to a droplet deposition apparatus including an ink actuator (100) for ejecting ink droplets; a control unit (130) for controlling droplet formation; and power supply means for supplying a drive voltage to the control unit (130); the drive voltage having a voltage amplitude ($V_{100}$); the control unit (130) having a plurality of drive signal sources (320) for defining the wave forms of said electric signals; means (470) for detecting at least one performance affecting value; and means (490) for generating an amplitude control signal in response to the performance affecting value; and wherein the power supply means (330) comprises means (350) for adjusting the amplitude of the drive voltage in response to the amplitude control signal; said power supply means being separated from said control unit.

9 Claims, 11 Drawing Sheets

INK JET PRINTER

TECHNICAL FIELD OF THE INVENTION

The present invention relates to a droplet deposition apparatus.

DESCRIPTION OF RELATED ART

Ink jet printers include an ink actuator for ejecting droplets of ink liquid on demand. Such an ink actuator is disclosed in U.S. Pat. No. 5,016,028. The actuator includes a plurality of channels having side walls which are displaceable in response to electric drive signals. When an electric drive signal is applied to a section of the wall, the wall will move, thereby causing the volume of corresponding channels to increase or decrease.

U.S. Pat. No. 4,275,402 describes a circuit arrangement for piezoelectric recording nozzles with control circuits providing control voltages to individual nozzles. A regulating circuit includes a temperature-dependent resistor sensing the environmental temperature to effect temperature regulation of the control voltages in accordance with the environmental temperature.

U.S. Pat. No. 5,631,675 describes an apparatus for driving an ink jet recording head having piezoelectric units which expand and contract as controlled by an electric field applied thereto. The apparatus according to U.S. Pat. No. 5,631,675 includes two constant current sources which operate to charge and discharge a capacitor. The voltage of the capacitor is amplified to provide the voltage for driving the piezoelectric units.

SUMMARY

A problem to which the present invention is directed is to improve print performance and increase the life time of the actuator.

This problem is addressed by providing a droplet deposition apparatus including:

- an ink actuator having a plurality of spaced walls defining ink channels, said walls having opposed sides; said opposed sides being provided with electrodes being adapted to receive electric signals to deform said walls to cause ink in said channels to be ejected therefrom;
- a control unit including a plurality of current sources for defining the wave forms of said electric signals;
- a temperature sensor for generating an amplitude control signal in response to a sensed actuator temperature;
- a power supply for providing a drive voltage to the control unit; said drive voltage having a voltage amplitude;
- the power supply having means for adjusting the amplitude of the drive voltage in response to the amplitude control signal; wherein
- said power supply is separated in space from said control unit and from said actuator and in that said electric signals include a controlled current.

This solution advantageously leads to reduced operating temperature of the actuator, and to an improved quality of the ejected ink. Since a high operating temperature leads to an accelerated ageing process of the ink in and near the actuator, which in turn leads to deteriorating print quality, this solution results in improved print quality. This solution provides particular improvement in print quality for printing conditions when the droplet deposition apparatus is turned on and operable for long times, but with small amounts of actual printouts. In such cases some ink remains in the actuator for long time periods before being deposited. With a droplet deposition apparatus as defined above, the heat generated by the power supply means is prevented from being transported to the actuator. Whereas an ink volume in the actuator of a prior art apparatus is kept warm for long time durations, such warming is avoided in a droplet deposition apparatus according to the above embodiment of the invention.

DETAILED DESCRIPTION OF EMBODIMENTS

Figure 1:
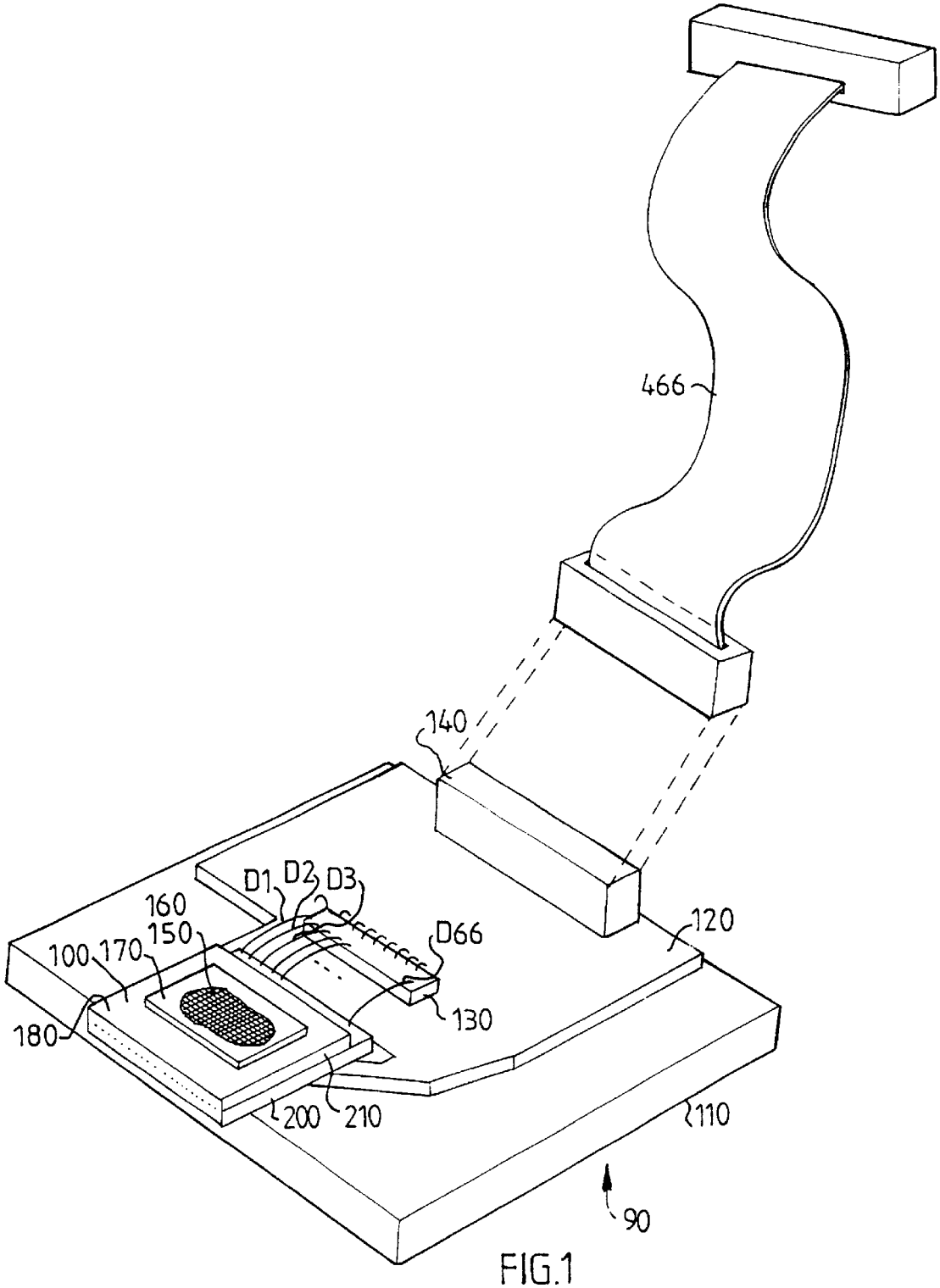
FIG. 1 is a perspective view of a print head arrangement including an actuator and a control unit coupled, via a cable, to a power supply and a data interface.

FIG. 1 is a perspective view of a print head arrangement 90 including an ink actuator 100 mounted on a base plate 110. The base plate may be arranged on a shuttle in an ink jet printer (not shown).

A circuit board 120 is also mounted on the base plate 110. The circuit board 120 includes a control unit 130 and a connector 140.

A central data processing unit in the printer or in a facsimile machine can be connected to the connector 140 and can supply print orders to the connector 140. The print orders thus supplied to the print head arrangement 90 are fed to the control unit 130. The control unit 130 transforms the print orders into electric pulses adapted to cause the actuator assembly 100 to eject ink drops in accordance with the print orders.

Ink is supplied from an ink reservoir (not shown) to an ink inlet 150 on the actuator assembly 100. The ink inlet 150 may include a filter 160. The ink inlet 150 also includes a sealing unit 170. The sealing unit 170 may include a rubber strip projecting a few tenths of a millimetre above a surface 160 of the actuator assembly 100, as shown in FIG. 1, in order to provide a tight seal when pressed towards a corresponding ink duct connector.

The actuator 100 comprises an actuator plate 200 and a cover plate 210. The actuator plate 200 is made from polarised piezoelectric material. The cover plate, which includes the ink inlet 150, is made from piezoelectric material which is not polarised.

Figure 2:
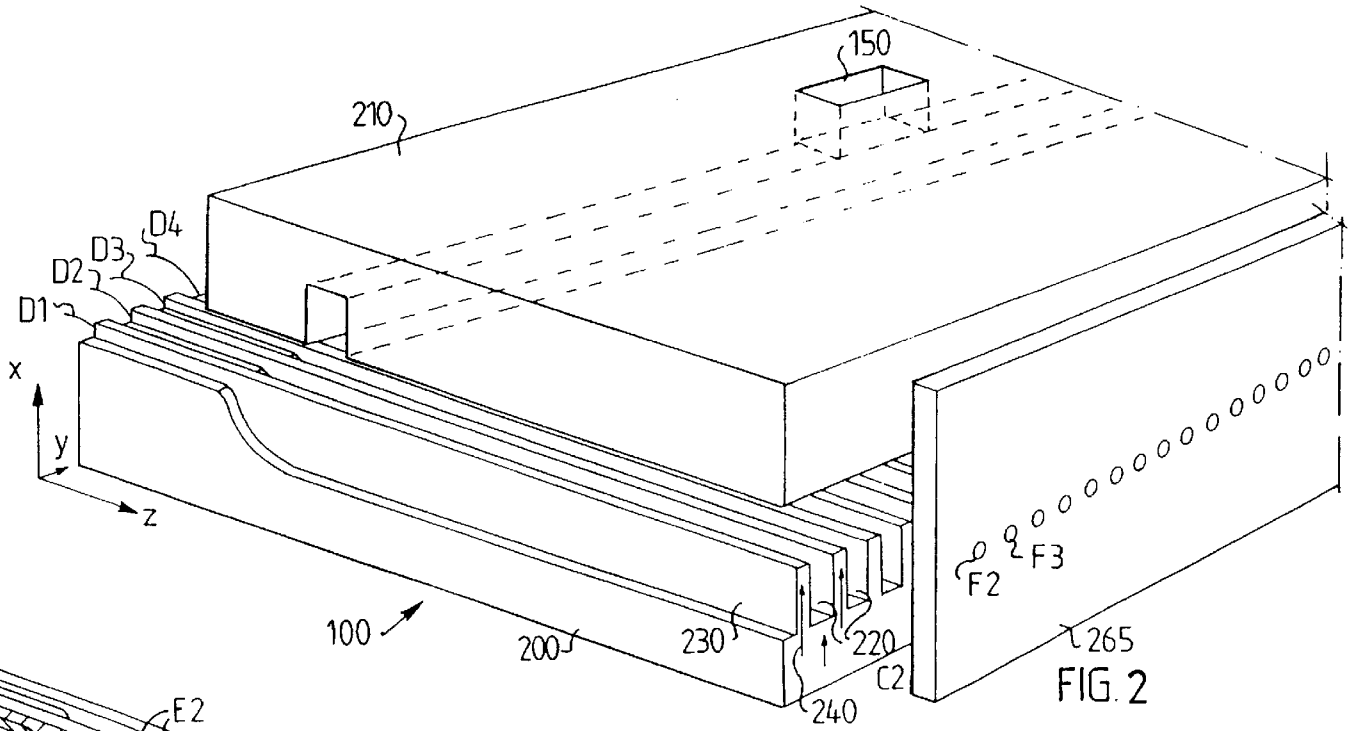
FIG. 2 is an exploded partly diagrammatic perspective view of a part of the actuator shown in FIG. 1.

FIG. 2 is an exploded partly diagrammatic perspective view of a part of the actuator 100.

The actuator plate 200 includes grooves of a rectangular cross-section forming channels 220. The channels 220 are separated by side walls 230. The whole actuator plate is poled in a direction parallel to the Z-axis in FIG. 2. The direction of polarisation is also illustrated by arrows 240 in FIG. 2.

Figure 3:
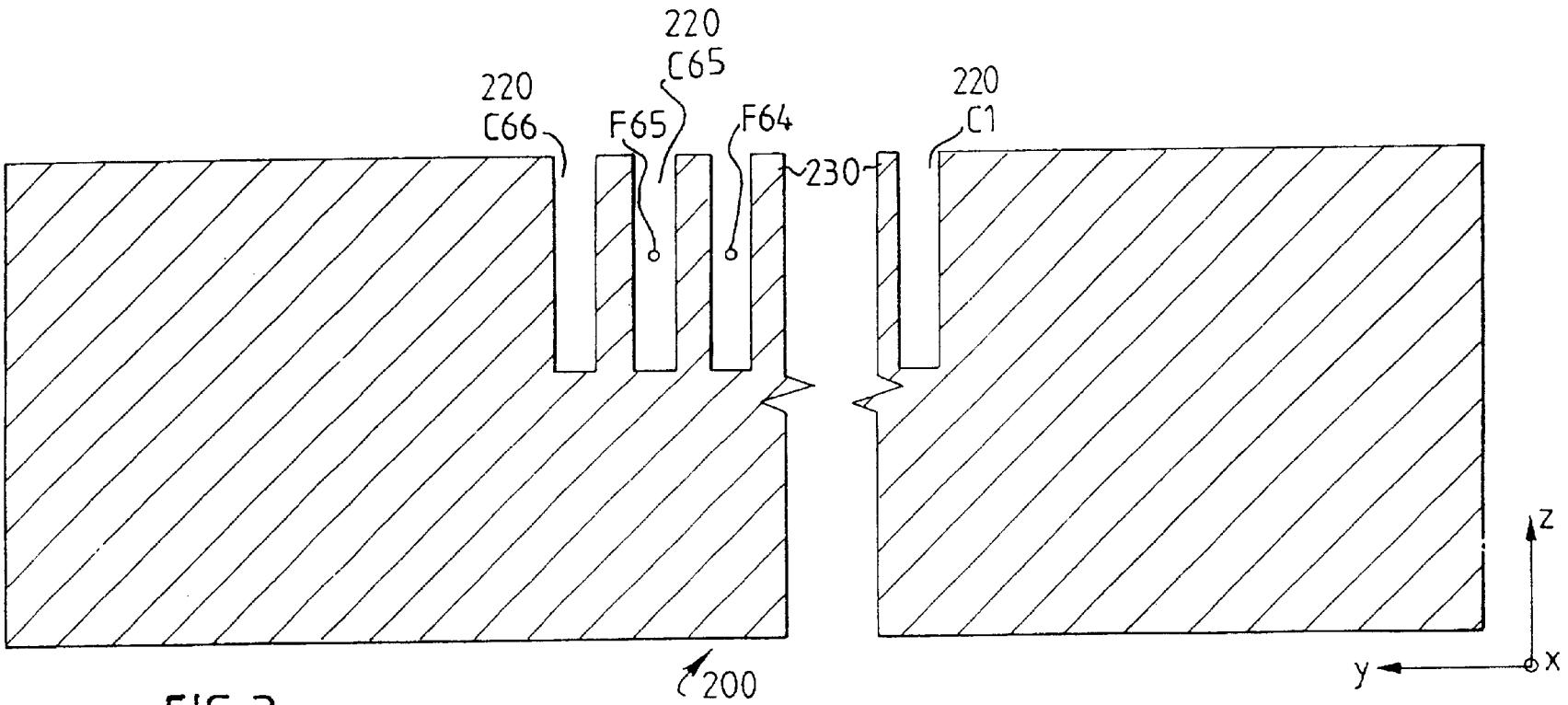
FIG. 3 is a sectional view of an actuator plate.

FIG. 3 is a sectional view of the actuator plate 200, as seen in the direction of the axis X.

According to one embodiment of the actuator assembly there are sixty-six channels 220. For easy reference the channels are individually referenced C1, C2, C3 . . . C66. Sixty-four (64) out of the 66 channels are active while two channels C1 and C66 are inactive and not used for expelling ink drops, as described in more detail below. The two inactive channels C1 and C66 are the first and the last channels as seen in the direction of the axis y in FIG. 2 or in FIG. 3.

Certain parts of the walls 230 are arranged to move in shear mode in relation to the ink channels 220 when activated by an electric field applied in a direction perpendicular to the direction of polarisation 240 of the wall 230. The side walls 230 are displaceable transversely relative to the channel axis to cause changes of pressure in the ink in the channels to effect droplet ejection from nozzles F2–F65 in a nozzle plate 265. The plate 265 is positioned in front of the open ends of the channels 220, and is provided with nozzle openings for ink droplet ejection.

Electrical connections D1, D2, D3 . . . D66 for activating the channel side walls 230 are made to the control unit by bond wires as illustrated in FIGS. 1, 2 and 4.

Figure 4:
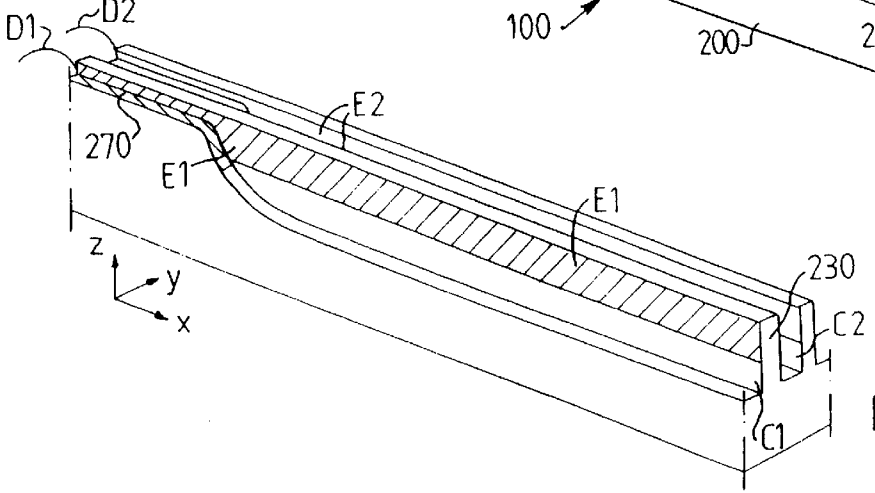
FIG. 4 is a sectional perspective view of a part of the actuator plate shown in FIG. 3.

FIG. 4 is a sectional perspective view of a part of the actuator plate 200. The bond wire D1 connects to a thin metal layer 270 (illustrated by dashed lines) arranged on a surface of the actuator plate 200. The metal layer also covers a part of the surface of the wall 230 facing towards channel C1 of the wall 230 as illustrated by the shaded area E1 in FIG. 4. Another bond wire D2 connects to metal layers E2 in channel C2 in the same manner. The metal layers E2 form electrodes on the surfaces facing channel C2 of the walls 230. The cover plate 210 is cemented onto the actuator plate 220 so as to define, together with the walls 230, channels 220 with nozzles F2, F3 . . . F65.

Figure 5A:
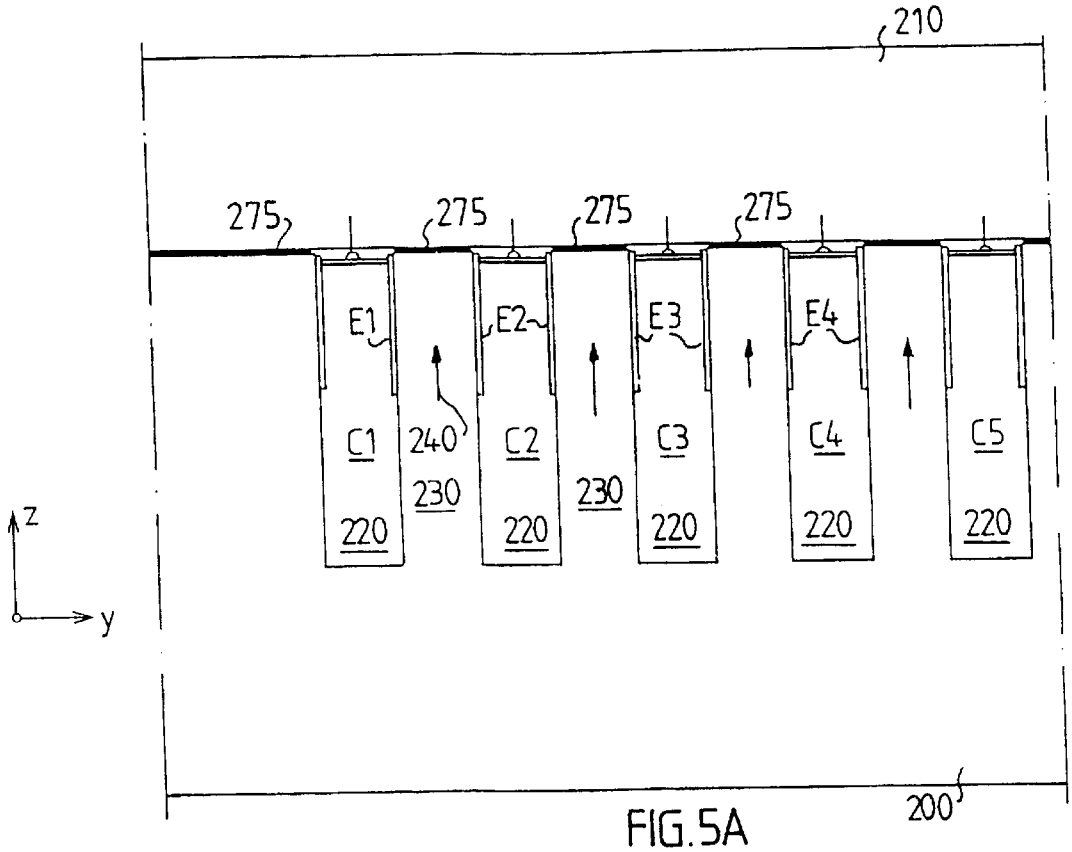
FIG. 5A is a cross-section of a part of the actuator shown in FIG. 1 and 2 shown in a relaxed state.

FIG. 5A is a cross-section of a part of the actuator assembly 100, as seen from the nozzle plate 265. In order to simplify understanding, the three axes x, y and z are shown in FIGS. 2, 3, 4 and 5. Reference numeral 275 indicates the joint where the cover plate 210 is cemented to each wall 230 comprised in the actuator plate 200. Thus, each wall 230 is firmly attached to the cover plate.

The channels C2, C3 . . . C65 can be activated individually as described above. As described above, the channel C1 on the far left edge, as seen in FIG. 2, is an inactive channel. The channel C66 on the far right edge is also an inactive channel, i.e. it is not used for ejecting ink.

Figure 5B:
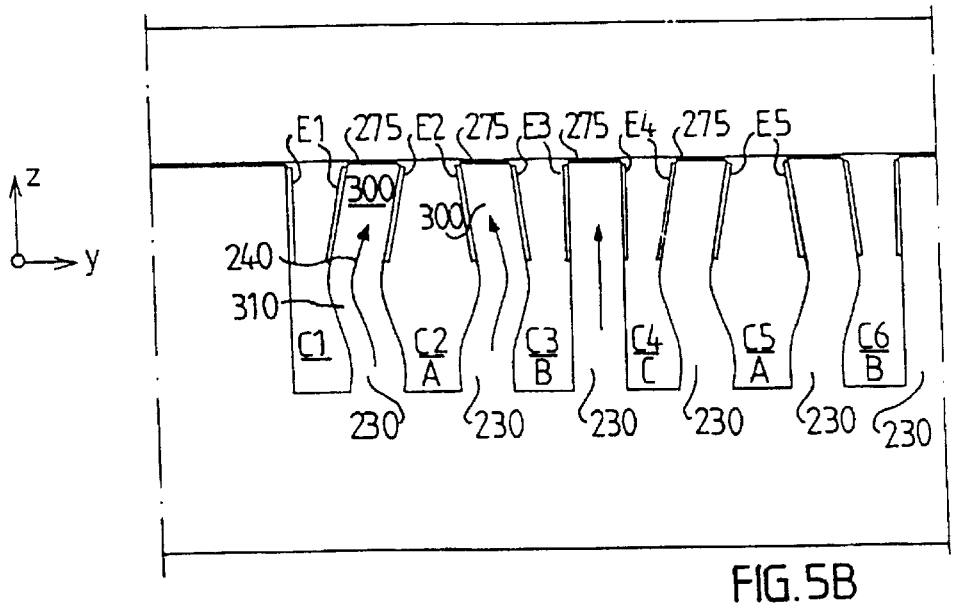
FIG. 5B is a cross-section of a part of the actuator shown in FIG. 1 and 2 with some channels shown in an expanded state

FIG. 5B illustrates channel C2 in an expanded state. The expansion is achieved by causing a current to flow from the electrodes E2 to the electrodes E1 and E3. Due to the impedance between the E2 and the electrode E1 there will be a potential $U_{21}$ between the electrode E2 and the electrode E1.

An electric field is thereby caused in a portion 300 in the wall 230 between the electrode E2 and the electrode E1 in a direction substantially perpendicular to the direction of polarisation 240. This causes the portion 300 of the wall to flex in a shear mode to the position shown in FIG. 5B. When the wall part 300 flexes, it also forces the complementary part 310 of the wall to bend in the same direction.

When channel C2 expands, it draws in more ink through the ink inlet 150 (best seen in FIG. 2).

Figure 6:
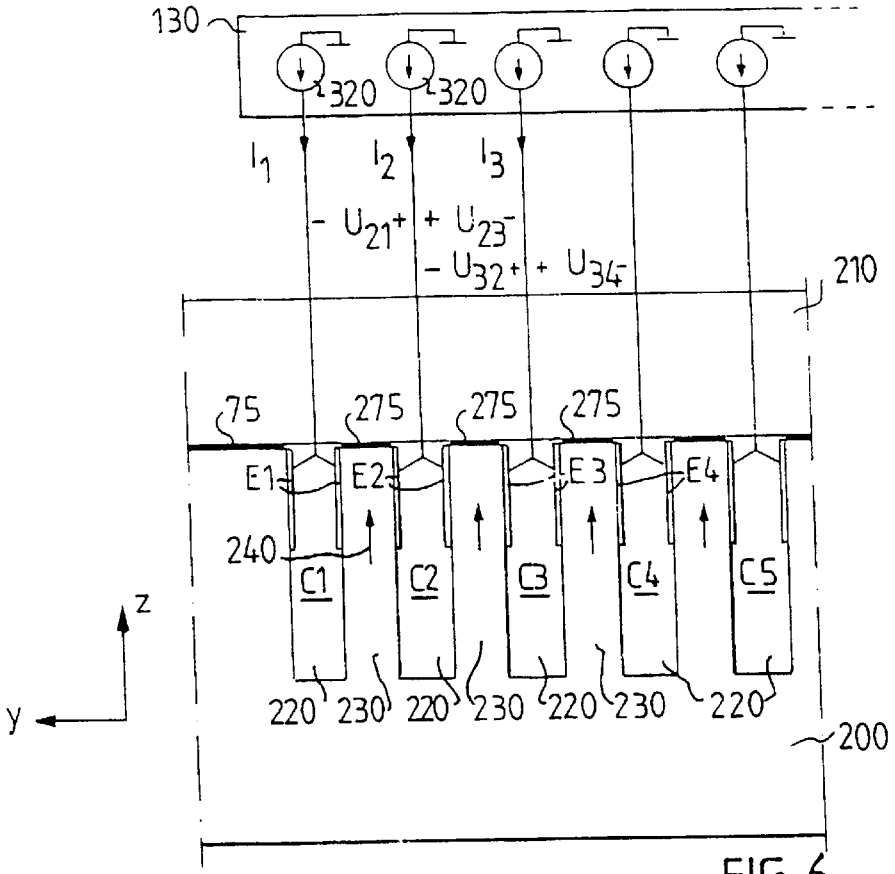
FIG. 6 is a partly schematic view showing electrode connections from an electrical point of view.

FIG. 6 is a partly schematic view showing the electrode connections from an electrical point of view. The electrodes E1 in channel C1 are connected to the control unit 130, as shown in FIG. 6.

The control unit comprises a current source 320 for each channel. There is thus one current source 320 for each channel C1–C66. Each current source 320 is coupled to the electrodes E in the corresponding channel, as illustrated in FIG. 6.

Each wall 230 is individually displaceable in dependence on the current between the electrodes on that wall. For example, the wall between channel C2 and channel C3 is displaceable in dependence on a current $I_{23}$ from electrode E2 to electrode E3.

Figure 7:
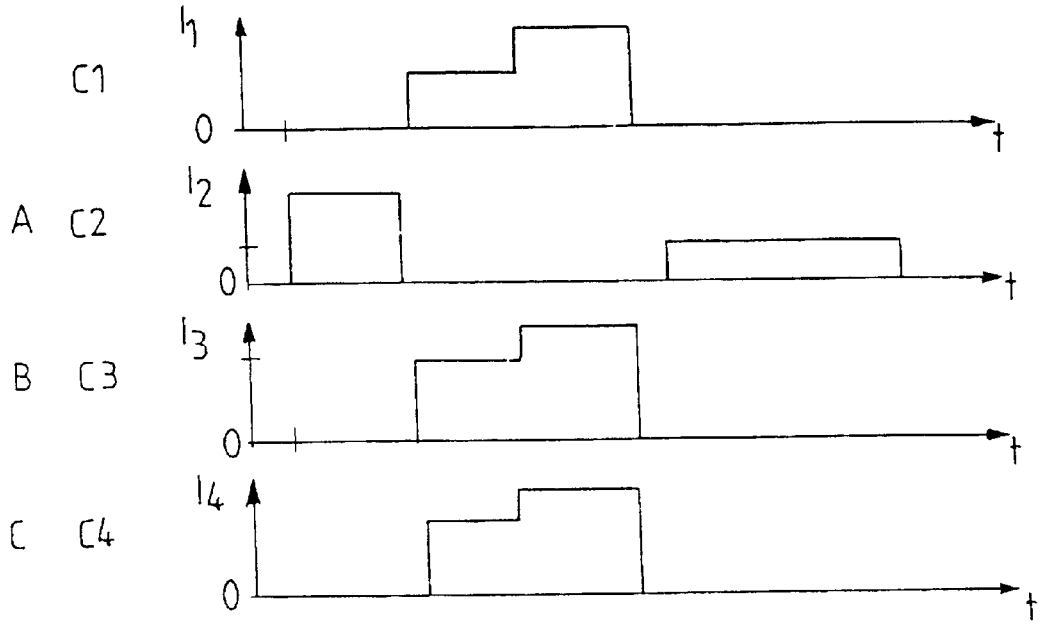
FIG. 7 illustrates an example of electric signal wave forms at the electrode connections when a maximal number of ink droplets is to be ejected.

FIG. 7 illustrates examples of electric pulses I1–I6 delivered to the electrodes E1–E6 when a maximal number of ink droplets are to be ejected.

Figure 8:
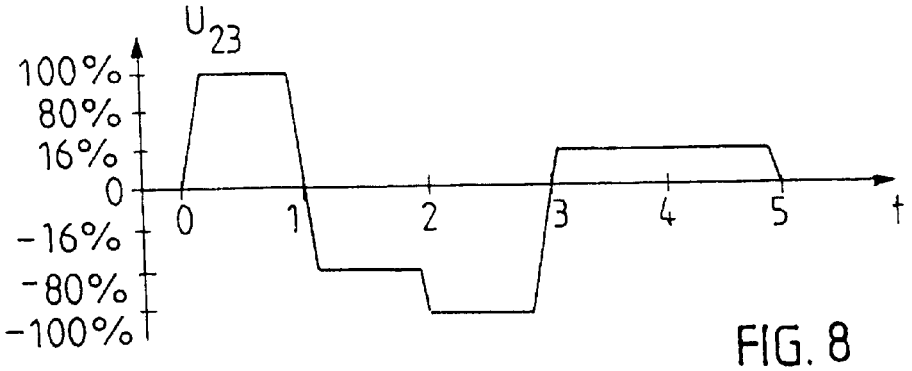
FIG. 8 illustrates an example of an electric signal wave form relating to one wall having two opposing sides with electrodes.

FIG. 8 illustrates an example of an electric signal wave form relating to the two opposing electrodes E2 and E3 on the wall between channel C2 and channel C3.

Certain essential properties of the ink, such as viscosity, change in dependence on ink temperature. In order to compensate for this temperature dependency, the temperature is measured by a temperature sensor and the voltage levels in the pulse wave forms are decreased with rising ink temperature. According to an embodiment of the invention the voltage top value is set to 35 volts when the actuator temperature is 20° C. According to another embodiment of the invention the voltage top value is set to its top value when the actuator temperature is 10° C. The voltage top level is herein referred to as the 100% voltage level. According to an embodiment of the invention the temperature sensor is a thermistor.

Figure 9:
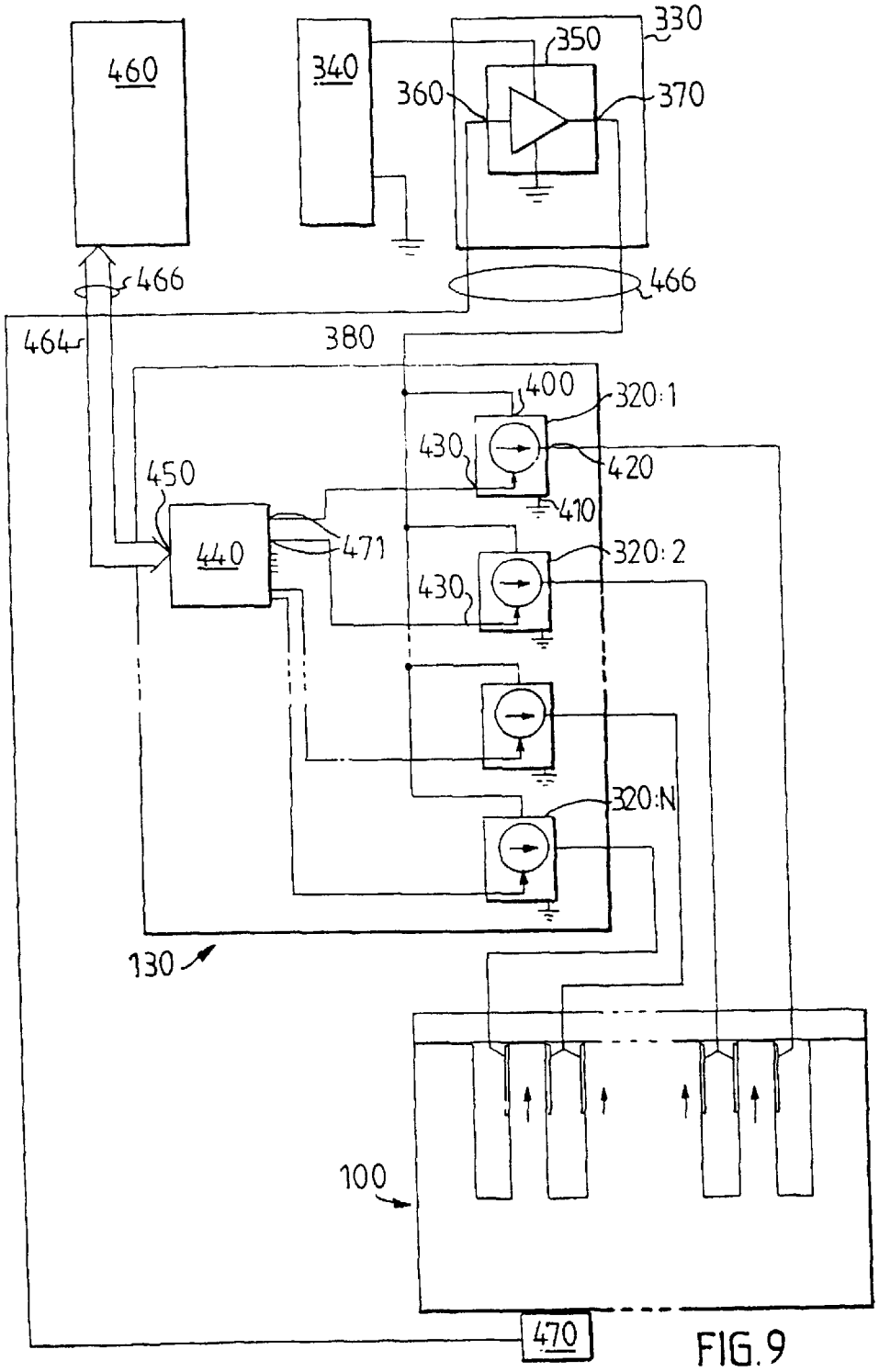
FIG. 9 is a block diagram of a printer arrangement including a control unit coupled to an actuator and to a power supply circuit, according to an embodiment of the invention.

FIG. 9 is a block diagram of an embodiment of the invention, comprising an actuator control circuit 130, a power supply circuit 330, and an actuator 100. The power supply circuit 330 is coupled to a DC power supply 340. The power supply 340 may for example provide a substantially constant voltage of 40 volts. The power supply circuit 330 comprises a drive voltage controller 350, having an input 360 for a power demand signal and a power supply output 370 for delivering a drive voltage with a controlled voltage Vcc. The controlled voltage $V_{cc}$ may for example be controllable from 10% of $V_{cc(100)}$ to 100% of $V_{cc(100)}$, where $V_{cc(100)}$=35 volts.

The actuator control unit 130 comprises a power supply input 380 which is coupled to the output 370 for receiving a controlled drive voltage. The control unit 130 comprises a plurality of controllable current sources 320, each current source having a drive voltage input 400 which is coupled to the power supply input 380. There may be provided N current sources, where N is an integer. Each current source 320:1, 320:2 . . . 320:N has an earth connection 410 and an actuator drive signal output 420. Each actuator drive signal output is coupled to the electrodes E of a corresponding channel wall in the actuator 100.

Each current source 320 also comprises an input 430 for a current control signal. The current control signal input is coupled to a data conversion unit 440. The data conversion unit comprises an input 450 for receiving print data indicative of the text or picture to be printed. The input 450 is adapted to be connected to a data interface 460 via a databus 464. With reference to FIGS. 1 and 9 a plurality of electrical conductors 466 are provided to connect the control unit 130 with the data interface 460 and the power supply circuit 330.

In response to print data received on the input 450 the data conversion unit 440 converts the print data into individual current control signals for each current source 320. For this purpose the data conversion unit 440 comprises a control signal output 471 corresponding to each current source 320, and hence a current control signal for each channel in the actuator.

The data conversion unit in co-operation with the controllable current sources 320 operates to generate drive currents on the outputs 420 such that the wave forms of the drive signals delivered to each actuator wall causes a controlled movement of each wall.

The voltage amplitude of the drive current on each output 420 depends on the voltage on the power supply input 380.

For the purpose of controlling the voltage level so as to compensate for the temperature dependency of the viscosity of the ink, the actuator includes a temperature sensor 470. The temperature sensor 470 provides a temperature signal which indicates the power demand for driving the actuator with optimum performance. The power demand signal input 360 of the power supply circuit is adapted to receive the signal from the sensor 470, or a demand signal derived from the sensor 470.

Figure 10:
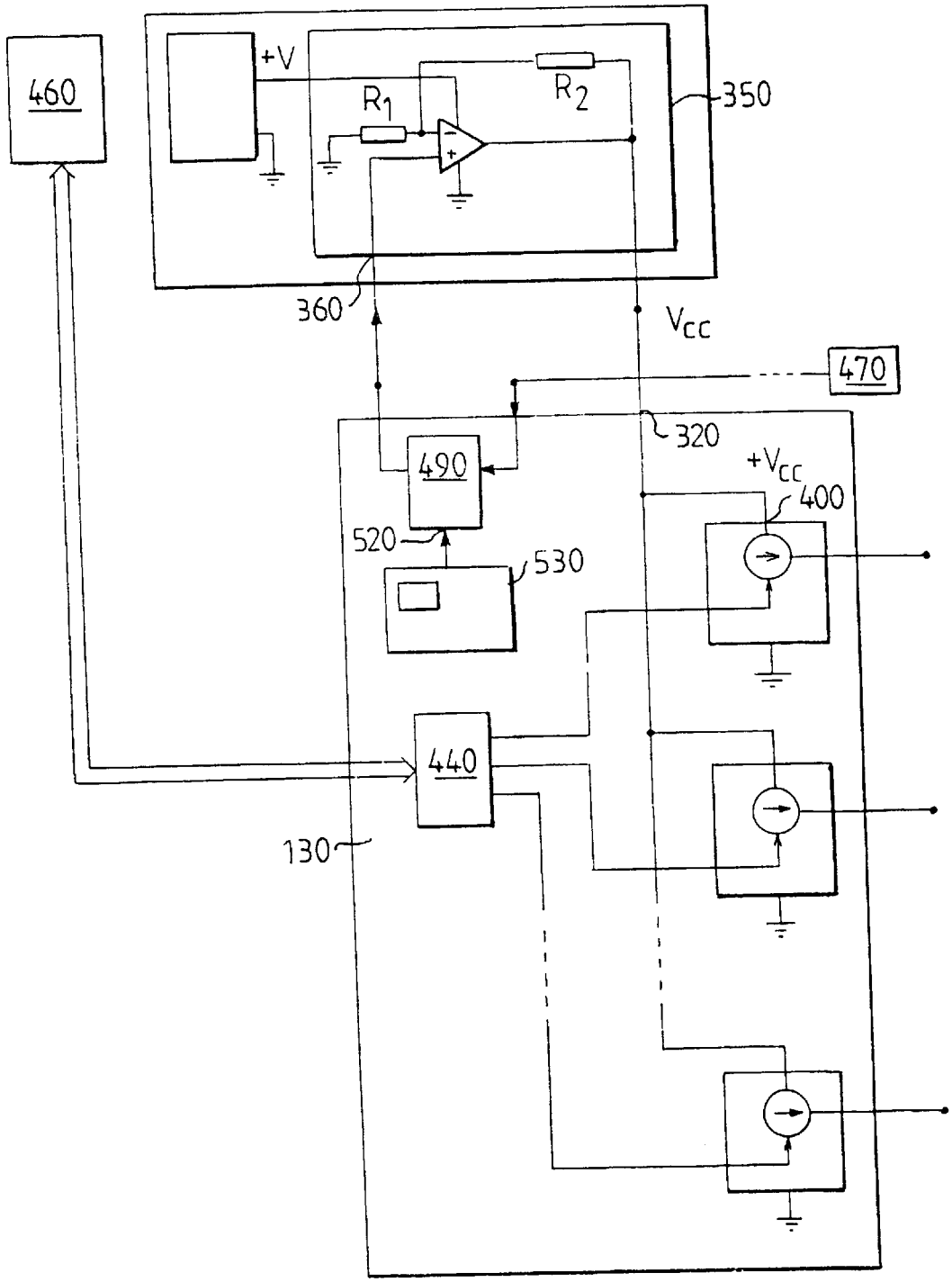
FIG. 10 is a block diagram of a printer arrangement including a control unit coupled to a power supply circuit and for connection to an actuator, according to another embodiment of the invention.

According to one embodiment of the invention the power demand signal delivered to the input 360 is derived from the signal from sensor 470 in combination with other performance affecting variables. FIG. 10 is a block diagram of another embodiment of the ink jet printing arrangement. The embodiment according to FIG. 10 differs from the embodiment according to FIG. 9 in that the sensor 470 is coupled to an evaluation circuit 490, which operates to generate a voltage demand signal in dependence on sensed temperature. The output of the evaluation circuit 490 is coupled to the input 360 of the power supply circuit 350.

According to one embodiment of the invention the evaluation circuit 490 comprises an input 520 for receiving additional data relating to the performance affecting variables such as for example actuator efficiency and/or type of liquid. Such data includes for example data defining the temperature dependency of the liquid to be ejected by the actuator. The evaluation circuit 490 is, according to a preferred embodiment, integrated with the control unit 130.

The additional data relating to performance of the actuator 100 are generated by an actuator status circuit 530. The actuator status circuit 530, also integrated in the control unit 130, includes a memory for storing data derived from measurements of the performance of the individual actuator control unit combination.

According to a preferred embodiment of the invention, the actuator control circuit 130 and the actuator 100 are arranged on a movable shuttle in a printer, while the data interface 460 and the drive voltage controller 350 are stationary parts in the printer. The set of conductors 466 is bendable so as to enable having one end attached to the firmly mounted power supply 330, and the other end connected to the movable shuttle which carries the control unit 130 and the actuator. Hence, the power supply 330 is separated in space from the control unit and from the actuator 100. As the shuttle with the control unit and the actuator 100 moves during printing operations the separating distance between them changes. The separation in space leads to reduction or elimination of warming of the actuator 100 by thermal radiation from the variable voltage supply 330.

Moreover the heat dissipation from the control unit to the actuator is reduced since the voltage drop in the control unit 130 is minimized. The signal sources 320 are designed for minimized voltage drop between the power input 380 and the outputs 420. The reduced power losses in the control unit thereby decreases the amount of heat generated in the immediate vicinity of the ink actuator, so as to reduce heat conduction from the control unit to the actuator.

Figure 11:
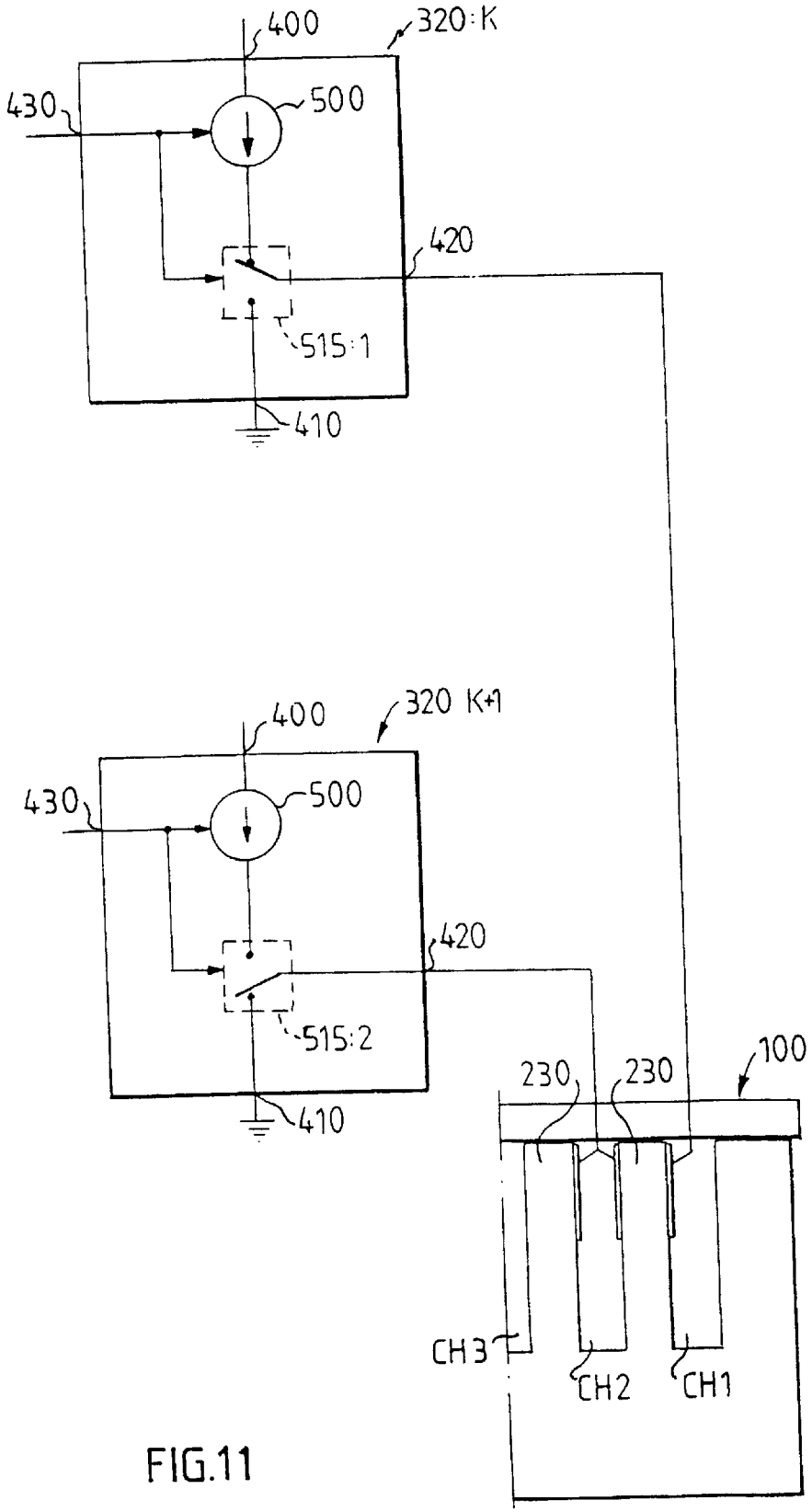
FIG. 11 is a block diagram of a controllable drive signal source, according to an embodiment of the invention.

FIG. 11 is a block diagram illustrating two of the controllable current signal sources 320:1 and 320:2 shown in FIG. 9, according to an embodiment of the invention. FIG. 11 also shows how two current sources 320:1 and 320:2 co-operate to provide a push-pull drive signal, as illustrated in FIG. 8, to an actuator wall 230 between channels CHk and CHk+1.

Hence, generally each actuator wall is connected to two individually controlled current sources 320:k and 320:k+1. As indicated by FIGS. 8, 9 and 11 an actuator wall is connected so as to receive a push-pull signal from one pair of current sources 320:k and 320:k+1 whereas other walls receive push-pull signals from other pairs of current sources 320:j and 320:j+1; where k and j are positive integers, and j never equals k. In other words a first actuator wall is coupled to receive a drive signal from a first pair of push-pull connected signal sources, and a second actuator wall is coupled to receive a drive signal from a second pair of push-pull connected signal sources, where the second pair is different from the first pair.

According to the invention there is provided a plurality of current signal sources 320, each such current source 320 being connected to at least one actuator wall. In this manner an improved print quality is enabled. This advantageous effect is obtained since control of the deflection of each wall is enabled by controlling the current delivered to it. In the embodiment shown in FIG. 9 there is provided one current source 320 for each actuator channel, and the current through one wall is determined by the current sources connected to the channels bordering that wall.

A current signal source 320 comprises a current source 500 receiving a drive voltage from the drive voltage input 400, and a control signal from the control signal input 430. The output of the current source 500 is coupled to a switch 515 for connecting the driver output 420 either to the output of the current source 500 or to ground 410. The switch 515 is also controlled by the signal from the control signal input 430. FIG. 11 illustrates a switch setting when current source 320:1 can drive a current via switch 515:1 through the wall between channels CH1 and CH2 and via switch 515:2 to ground.

Figure 12:
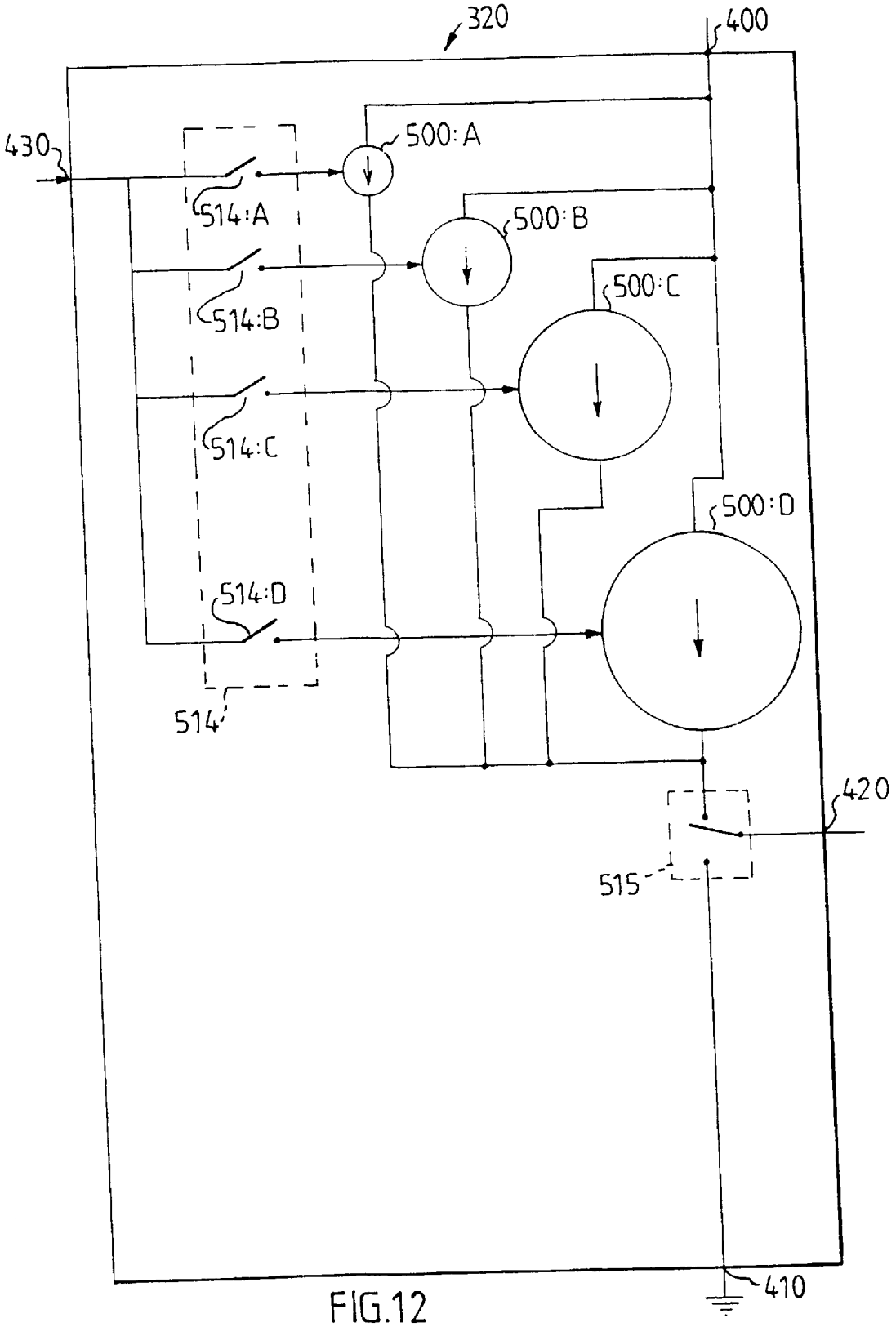
FIG. 12 is a block diagram of a controllable drive signal source, according to another embodiment of the invention.

FIG. 12 is a block diagram of a controllable drive signal source 320, according to another embodiment of the invention. Tests made by the inventors have shown that drop velocity depends on the slew rate of the drive signal shown in FIG. 8. In order to control the slew rate of the voltage pulse the drive signal source is constructed with four output current sources 500:A, 500:B, 500:C, 500:D. Current source 500:B provides twice the current of current source 500:A., current source 500:C provides twice the current of current source 500:B, and current source 500:D provides twice the current of current source 500:C. Hence, a current ratio 1:2:4:8 is obtained. A switch unit 514, having switches 514:A, 514:B, 514:C and 514:D controls the activation of the individual current sources 500:A, 500:B, 500:C and 500:D, respectively. The current sources 500 include output devices, wherein the geometric area of an output device is directly proportional to the current it can provide, thereby making slew rate control possible. According to an embodiment the output devices 500:A, 500:B, 500:C, 500:D are integrated circuit MOS transistors.

The driver stage 320 is push-pull connected. The outputs of the current sources 500:A, 500:B, 500:C, 500:D are coupled to a switch 515 for connecting the driver output 420 to the outputs of the current sources 500:A, 500:B, 500:C, 500:D or to ground 410. According to an embodiment there is provided a number of current sources (not shown) between the switch 515 and ground 410 so as to enable control of the negative slope of the pulse signal delivered on output 420. These current sources are pulling current sources of values corresponding to the pushing current sources 500:A, 500:B, 500:C, 500:D, and these current sources are also controlled by the switch means 514. According to another version there is provided a separate switch for controlling the pulling current sources.

Figure 5C:
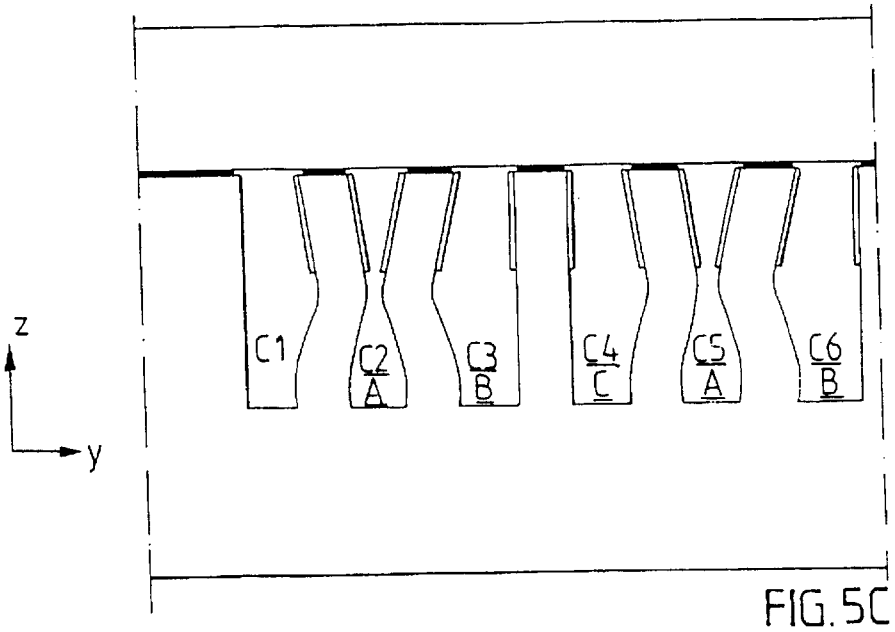
FIG. 5C is a cross-section of a part of the actuator shown in FIG. 1 and 2 with some channels shown in a contracted state.
Figure 13:
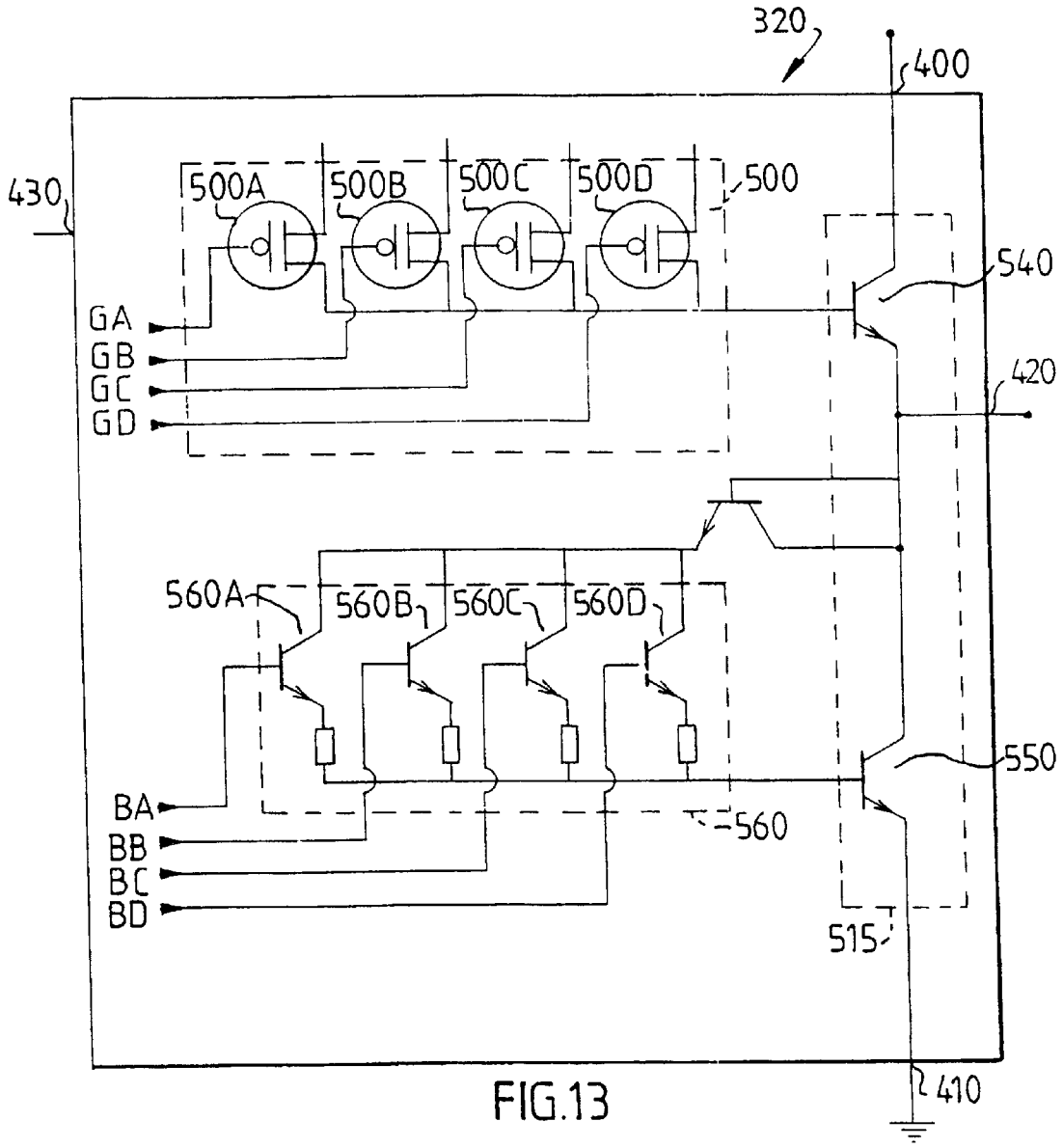
FIG. 13 is a schematic of an embodiment of a controllable drive signal source.

FIG. 13 is a schematic of an embodiment of a controllable drive signal source 320. Each of the N actuator channels is coupled to a non-inverting drive signal source 320. The actuator load appears as a large capacitor and parallel resistor strung between each neighbouring driver output. The dielectric of these capacitors is formed by the piezoelectric material in the wall 230 (FIG. 2). In order to draw in liquid in the k:th channel the driver 320:k drives the output 420:k to the positive rail, whilst the outputs 420:k−1 and 420:k+1 of the neighbouring channels ($C_{k-1}$ and $C_{k+1}$) are held at the negative rail. This charges the two capacitors of the walls of channel $C_k$. During the droplet ejection stage, a reverse polarity pulse is applied, see FIGS. 5, 7 and 8, reversing the charge polarity of the wall capacitor. Again, this deflects the channel walls so as to contract the channel (FIG. 5C). Finally, during a recovery stage the potential across the wall 230 is restored to zero as the wall capacitance is discharged to their initial state.

With reference to FIG. 13 there is provided a two output bipolar NPN-transistors 540 and 550 forming the switch 515. A number of MOS transistors form the current sources 500:A, 500:B, 500:C and 500:D, as described above, for driving the output 420 to the positive. In a similar manner a number of NPN-transistors 560A, 560B, 560C, and 560D act as current sources 560 for driving the output 420 to the negative rail. The output drive capacity of the output bipolar NPN-transistors 540 and 550 is determined by the MOS transistors 500:A, 500:B, 500:C, 500:D and by the NPN-transistors 560A, 560B, 560C, and 560D. The MOS transistors 500 and the NPN-transistors 560 limit the available base current for the NPN-transistors 540 and 550, thereby determining the slew rate when switching these devices in a controlled manner. The output state is determined by control signals GA, GB, GC, GD, BA, BB, BC and BD which are related to the signal on control signal input 430, as described above. With reference to FIG. 13 and FIG. 12 in conjunction with the associated description, a switch 514, e.g. in the form of a fusible link memory, may be provided between the input 430 and the terminals GA, GB, GC, GD, BA, BB, BC and BD.

What is claimed is:

1. A droplet deposition apparatus including:

an ink actuator having a plurality of spaced walls defining ink channels, said walls having opposed sides provided with electrodes adapted to receive electric signals to deform said walls to cause ink in said channels to be ejected therefrom;

a control unit including one or more current sources, each current source capable of producing an electrical current for defining wave forms of said electric signals;

a temperature sensor for generating an amplitude control signal in response to a sensed actuator temperature; and, a power supply for providing a drive voltage to the control unit, said drive voltage having a voltage amplitude, the power supply having means for adjusting the amplitude of the drive voltage in response to the amplitude control signal, said power supply being separated in space from said control unit and from said actuator, and said electric signals including a controlled current.

2. The droplet deposition apparatus according to claim 1, wherein a first actuator wall is coupled to receive a drive signal from a first pair of push-pull connected signal sources, and a second actuator wall is coupled to receive a drive signal from a second pair of push-pull connected signal sources, said second pair being different from said first pair.

3. The droplet deposition apparatus according to claim 2, wherein said walls are elongate so as to define a plurality of substantially parallel and elongate ink channels.

4. The droplet deposition apparatus according to claim 3, wherein a piezoelectric material of said walls is poled in a direction substantially parallel to said sides of said walls, and substantially perpendicular to the direction of elongation of said channels.

5. A droplet deposition apparatus comprising:

an ink actuator for ejecting ink droplets in response to electric signals;

a control unit for controlling droplet formation;

power supply means for supplying a drive voltage to the control unit, the drive voltage having a voltage amplitude, the control unit having one or more current sources, each current source capable of producing a plurality of electrical currents for defining wave forms of said electric signals;

a detector for generating a value indicative of an actuator temperature; and, means for generating an amplitude control signal in response to the temperature value, wherein the power supply means includes means for adjusting the amplitude of the drive voltage in response to the amplitude control signal, said power supply means being separated in space from said control unit and from said actuator, and said electric signals including a controlled current.

6. The droplet deposition apparatus according to claim 5, wherein the actuator is positioned closer to the control unit than to the power supply means.

7. The droplet deposition apparatus according to claim 6, wherein the power supply means is adapted for connection to a power source delivering a voltage having a first amplitude, said controlled drive voltage amplitude deviating from said first amplitude such that a voltage difference is obtained, the voltage difference being larger than a voltage drop between a drive voltage input and an output of a current source in the control unit.

8. The droplet deposition apparatus according to claim 7, wherein the power supply means is stationary; and the actuator is provided on a carriage which is movable in relation to the power supply means.

9. The droplet deposition apparatus according to claim 8, comprising conductor means adapted for connecting the variable voltage supplied at the power supply output to the movable actuator control unit such that a voltage drop in the control unit near the actuator is minimized.

* * * * *